US008160881B2

(12) United States Patent
Klee et al.

(10) Patent No.: US 8,160,881 B2
(45) Date of Patent: Apr. 17, 2012

(54) HUMAN-ASSISTED PRONUNCIATION GENERATION

(75) Inventors: Matthew M. Klee, Lynnfield, MA (US); Karen M. Cross, Mountain View, CA (US); Brian J. Murphy, San Jose, CA (US)

(73) Assignee: Microsoft Corporation, Redmond, WA (US)

( * ) Notice: Subject to any disclaimer, the term of this patent is extended or adjusted under 35 U.S.C. 154(b) by 678 days.

(21) Appl. No.: 12/334,590

(22) Filed: Dec. 15, 2008

(65) Prior Publication Data

US 2010/0153115 A1 Jun. 17, 2010

(51) Int. Cl.
*G10L 13/08* (2006.01)

(52) U.S. Cl. ..... 704/260

(58) Field of Classification Search ..... 704/260
See application file for complete search history.

(56) References Cited

U.S. PATENT DOCUMENTS

| | | | | |
|---|---|---|---|---|
| 5,850,629 | A * | 12/1998 | Holm et al. | 704/260 |
| 5,893,132 | A * | 4/1999 | Huffman et al. | 715/201 |
| 5,933,804 | A | 8/1999 | Huang et al. | 704/244 |
| 6,973,427 | B2 * | 12/2005 | Hwang et al. | 704/249 |
| 6,990,450 | B2 | 1/2006 | Case et al. | 704/260 |
| 7,099,828 | B2 | 8/2006 | Kobal et al. | 704/270 |
| 7,292,980 | B1 | 11/2007 | August et al. | 704/254 |
| 7,433,819 | B2 * | 10/2008 | Adams et al. | 704/251 |
| 2005/0137872 | A1 | 6/2005 | Brady | 704/269 |
| 2005/0177369 | A1 | 8/2005 | Stoimenov et al. | 704/260 |
| 2007/0220054 | A1 | 9/2007 | Hunter et al. | 707/104.1 |
| 2007/0239455 | A1 | 10/2007 | Groble et al. | 704/260 |

OTHER PUBLICATIONS

Fukada et al., "Automatic Generation of Multiple Pronunciations based on Neural Networks and Language Statistics," http://citeseerx.ist.psu.edu/viewdoc/summary?doi=10.1.1.41.426, and ATR Interprety Telecommunications Research Laboratories, 6 pgs.

P.A. Taylor et al., "An Interactive Synthetic Speech Generation System," http://ieeexplore.ieee.org/stamp/stamp.isp?arnumber=00181341, IEEE Xplore, Oct. 10, 2008, 3 pgs.

* cited by examiner

*Primary Examiner* — Susan Mcfadden
(74) *Attorney, Agent, or Firm* — Merchant & Gould

(57) ABSTRACT

Pronunciation generation may be provided. First, a pronunciation interface may be provided. The pronunciation interface may be configured to display a word and a plurality of alternatives corresponding to a one of a plurality of parts of the word. The plurality of parts may comprise phonemes or syllables of the word. Next, pronunciation data may be received through the pronunciation interface. The pronunciation data may indicate one of the plurality of alternatives. Then a pronunciation of the word may be generated based upon the received pronunciation data. The pronunciation may correspond to the indicated one of the plurality of alternatives. In addition, the pronunciation data may indicate which one of the plurality of parts of the word is stressed. This stress indication may be received in response to a user sliding a user selectable element to indicate which one of the plurality of parts of the word is stressed.

20 Claims, 6 Drawing Sheets

HUMAN-ASSISTED PRONUNCIATION GENERATION

BACKGROUND

Interactive voice response (IVR) is a technology that allows a computer to detect voice and keypad inputs. IVR technology is used in telecommunications, but is also being introduced into automobile systems for handsfree operation. An IVR system can respond to and further direct a user on how to proceed. IVR systems can be used to control almost any function where the interface can be broken down into a series of menu choices.

IVRs, however, are fundamentally limited when it comes to proper names and places whose pronunciations do not follow predictable rules. Fully automated IVRs produce an audio file that, in the worst cases, is unrecognizable due to faulty pronunciations. These faulty pronunciations cause IVRs to be harder to understand, harder to use, and less engaging. Moreover, this problem is particularly difficult with regard to internationalization (e.g. Chinese characters) or with systems that rely on recognizability of proper names for performance.

SUMMARY

This Summary is provided to introduce a selection of concepts in a simplified form that are further described below in the Detailed Description. This Summary is not intended to identify key features or essential features of the claimed subject matter. Nor is this Summary intended to be used to limit the claimed subject matter's scope.

First, a pronunciation interface may be provided. The pronunciation interface may be configured to display a word and a plurality of alternatives corresponding to a one of a plurality of parts of the word. Next, pronunciation data may be received through the pronunciation interface. The pronunciation data may indicate a one of the plurality of alternatives. Then a pronunciation of the word may be generated based upon the received pronunciation data. The pronunciation may correspond to the indicated one of the plurality of alternatives.

Both the foregoing general description and the following detailed description provide examples and are explanatory only. Accordingly, the foregoing general description and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present invention. In the drawings.

DETAILED DESCRIPTION

Figure 1:
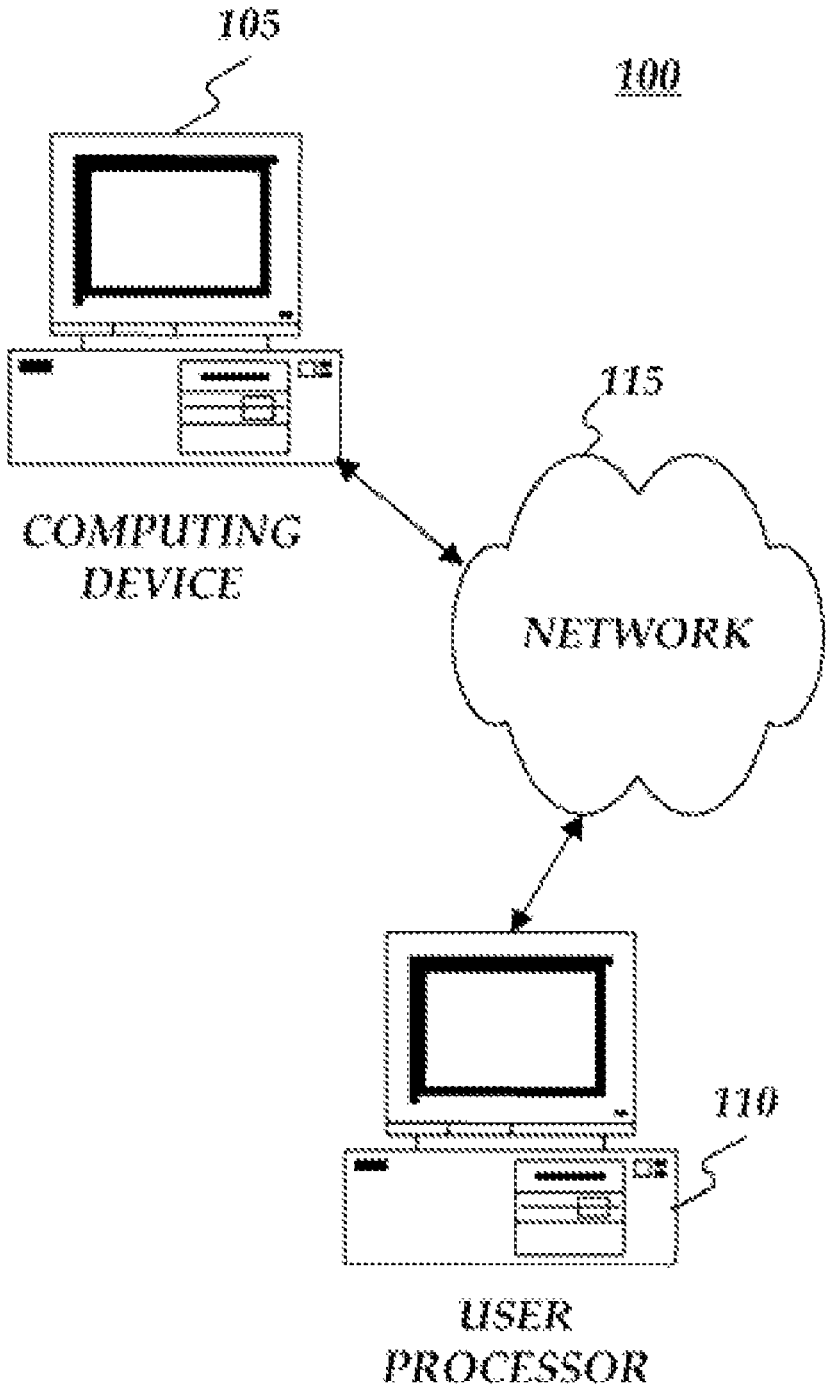
FIG. 1 is a block diagram of an operating environment.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention. Instead, the proper scope of the invention is defined by the appended claims.

Embodiments of the invention may provide a process for a user to supplement and improve the linguistic quality of a computer-generated audio file. In this way, users can control, for example, how their name, business, or other information is pronounced. This process may be useful in global or international use cases so a user can ensure that the user's name or business is pronounced correctly in directory assistance or other voice applications. By making a tool that any user, including those who have not had formal linguistic or speech training, can use, a significant number of people may be empowered to use the process. This broadens the process into the realm of crowdsourcing, where thousands of users can make pronunciation improvements that increase the audio experience of millions of others.

FIG. 1 shows an operating environment 100 consistent with embodiments of the invention. As shown in FIG. 1, a computing device 105, running a pronunciation application, may provide a pronunciation interface to the user using user processor 110 over a network 115. Computing device 105 may comprise or otherwise work in conjunction with an IVR. Notwithstanding, embodiments of the invention may be used in conjunction with any audio only system (e.g., an automated teller machine (ATM) that when presented with an ATM card says "welcome back Antonio", etc.) Computing device 105 is described in more detail below with respect to FIG. 6.

Consistent with embodiments of the invention, the user may interact with the pronunciation interface to edit, for example, a given text string's sound and stress. For example, the pronunciation of the text string "Delapena" such as in "Delapena Automotive" can be set by the user using the pronunciation interface. The user can provide pronunciation data though the pronunciation interface to set the pronunciation, for example, as either "Day' la pee nah" or "Day la pain' yah." Once the pronunciation is set, the pronunciation application can use the pronunciation data received through the pronunciation interface to generalize corresponding audio across contexts (including use in different prompts and applications) and can "learn" from the received data to improve performance of un-trained terms.

Figure 2:
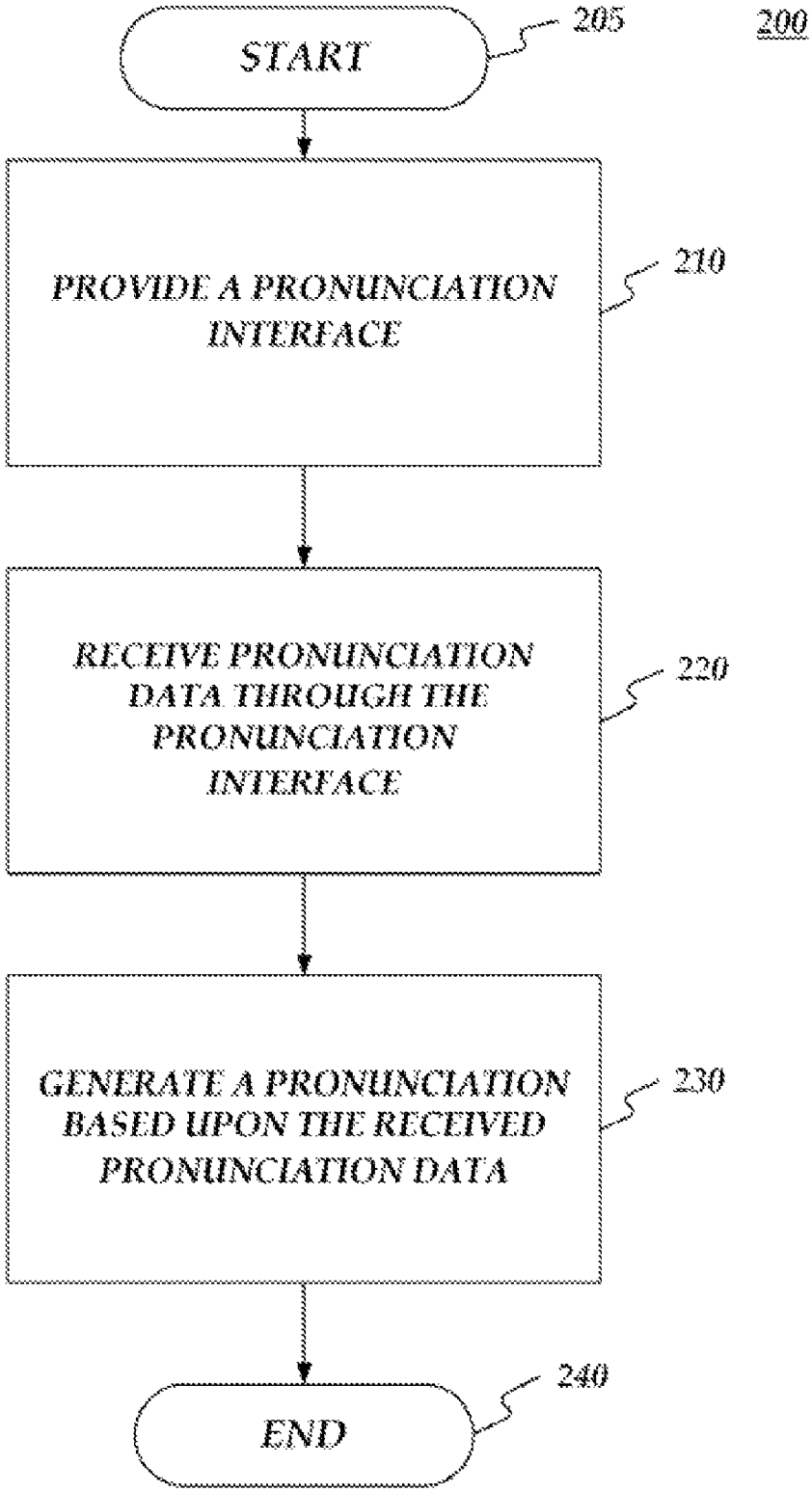
FIG. 2 is a flow chart of a method for providing human-assisted pronunciation generation.

FIG. 2 is a flow chart setting forth the general stages involved in a method 200 consistent with embodiments of the invention for providing pronunciation generation. Method 200 may be implemented using computing device 105 as described above with respect to FIG. 1 and as described in more detail below with respect to FIG. 6. Ways to implement the stages of method 200 will be described in greater detail below.

Figure 3:
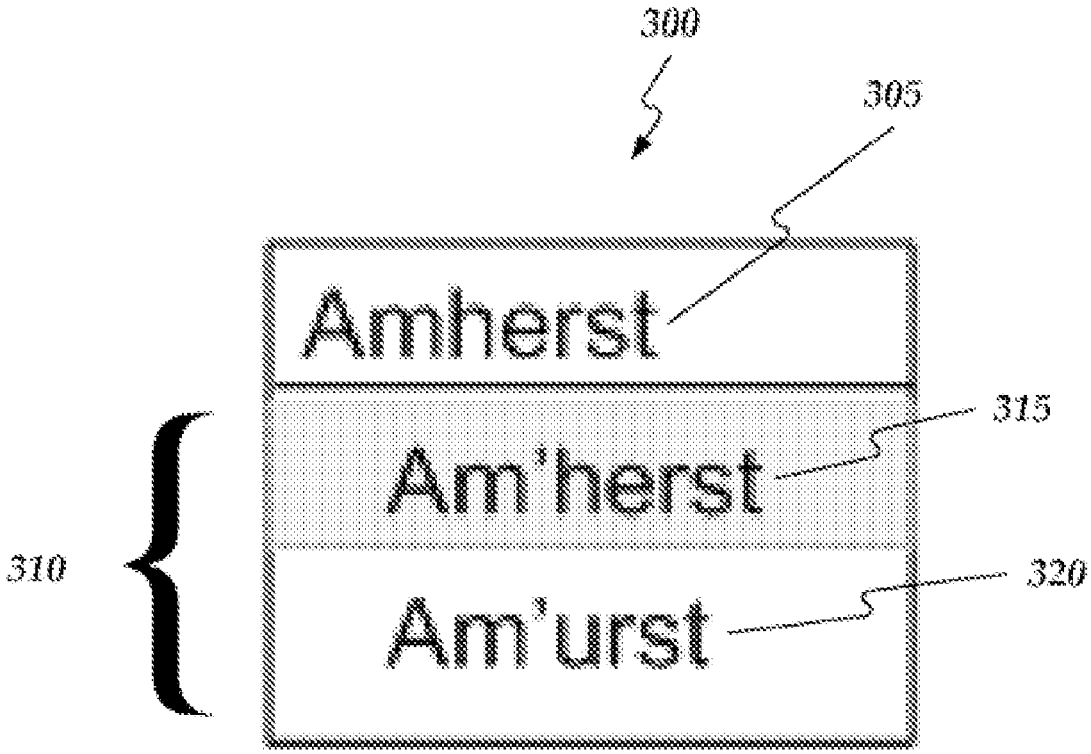
FIG. 3 is a drop down list menu.
Figure 4B:
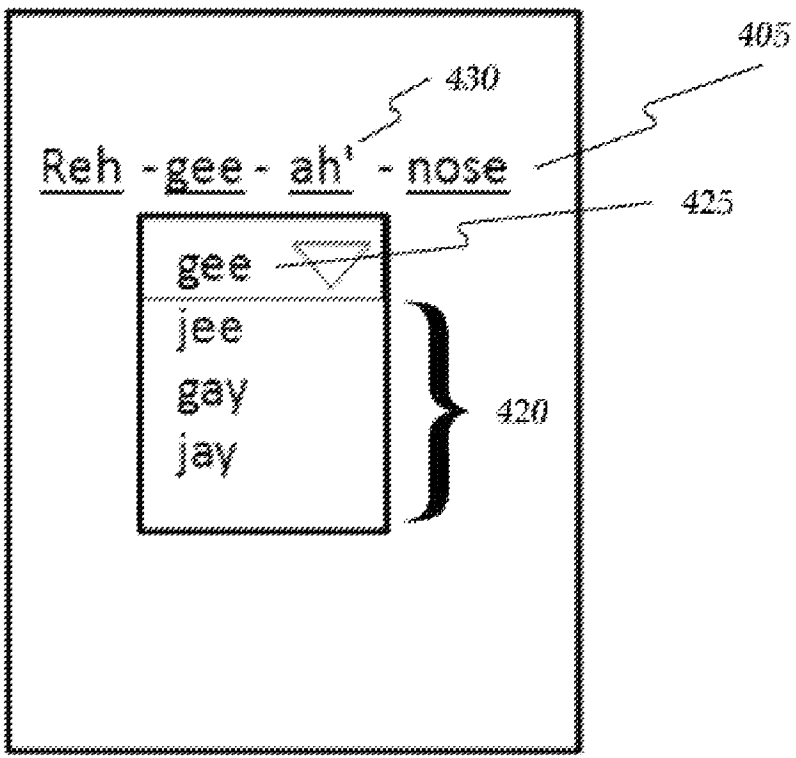
FIGS. 4A and 4B are manipulation menus.
Figure 4A:
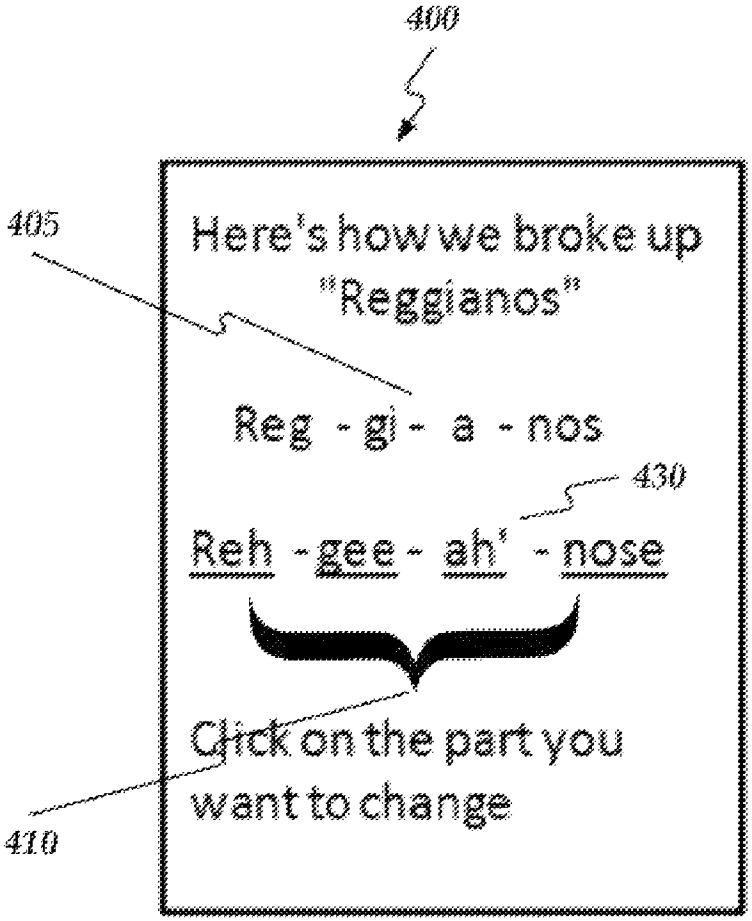
Figure 5:
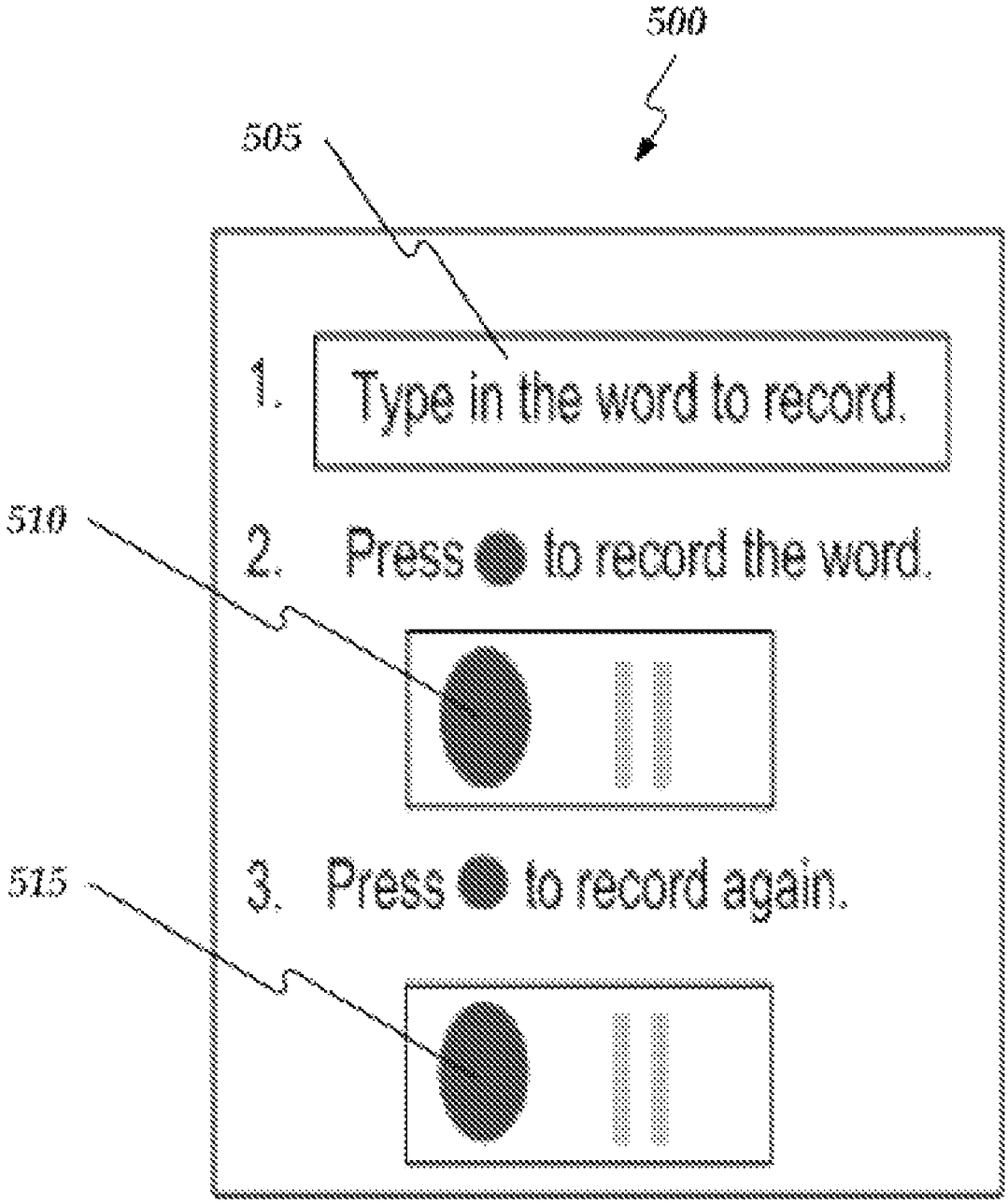
FIG. 5 is an input menu.

Method 200 may begin at starting block 205 and proceed to stage 210 where computing device 105 may provide a pronunciation interface. Computing device 105, running a pronunciation application (e.g. pronunciation application 620 as described in greater detail below,) may provide a pronunciation interface to user processor 110 over network 115. The provided pronunciation interface may comprise, but is not limited to a drop down list menu 300 as shown in FIG. 3, a first manipulation menu 400 as shown in FIG. 4A, a second manipulation menu 415 as shown in FIG. 4B, or an input menu 500 as shown in FIG. 5. The provided pronunciation interface will be described in greater detail below.

From stage 210, where computing device 105 provides the pronunciation interface, method 200 may advance to stage 220 where computing device 105 may receive pronunciation data through the pronunciation interface. The user may provide the pronunciation interface with the pronunciation data by interacting with the pronunciation interface on user processor 110 to edit, for example, a given word's, sub-word's, or text string's pronunciation (e.g. sound and stress.) Once the user provides the pronunciation data to the pronunciation interface, the user may cause the pronunciation data to be transmitted from user processor 110 to computing device 105 over network 115. The user may provide the pronunciation data to the pronunciation interface in a number of different ways as described below with respect to FIG. 3, FIG. 4A, FIG. 4B, and FIG. 5.

FIG. 3 shows drop down list menu 300. Consistent with embodiments of the invention, computing device 105 may have a text string that it may make audible. To give the user the opportunity to set pronunciation for the text string, computing device 105 may break the text string into words and present these words to the user in the pronunciation interface. As shown in FIG. 3, drop down list menu 300 may comprise all or a part of the pronunciation interface presented by computing device 105 to the user on user processor 110 over network 115. For example, a word 305 comprising "Amherst", may be one word or pronunciation from the text string. As shown in FIG. 3, word 305 may be presented along with a plurality of alternatives 310 comprising, for example, a first alternative 315 (e.g. "Am'herst") and a second alternative 320 (e.g. "Am'urst".) Plurality of alternatives 310 may present to the user in visual form alternate words or pronunciations of word 305 that the user could select. Plurality of alternatives 310 may also present alternate pronunciations for heterographs that are spelled the same but pronounced differently, like "read," or words that have multiple pronunciations like "address."

In response, the user may select between plurality of alternatives 310 based upon which pronunciation the user prefers. The user may then use the pronunciation interface to transmit back to computing device 105 the user's preference. Computing device 105 may play back to the user an audible version on word 305's selected pronunciation.

FIGS. 4A and 4B respectively show first manipulation menu 400 and second manipulation menu 415. As stated above, computing device 105 may have a text string that computing device 105 is to make audible. Computing device 105 may search through existing audio libraries stored in memory and piece together an audio version of the text string. The user, however, may not be satisfied with the aforementioned audio version. To give the user the opportunity to set pronunciation for the text string, computing device 105 may break the text string into words and present these words to the user in the pronunciation interface. Consistent with embodiments of the invention, the words in the text string may be broken down further into parts (e.g. syllables, phonemes, letters, etc.) from which the user can then select from alternatives in the pronunciation interface.

As shown in FIG. 4A, the pronunciation interface may comprise first manipulation menu 400. First manipulation menu 400 may present a word 405, (e.g. "Reggianos") to user. In addition, a plurality of parts 410 corresponding to word 405 may also be presented. The user may then select which part from plurality of parts 410 the user would like to work with. For example, if the user selects "gee" (i.e., the second part from plurality of parts 410,) second manipulation menu 415 as shown in FIG. 4B may be presented to the user. In second manipulation menu 415, a plurality of alternatives 420 corresponding to the part selected from plurality of parts 410 in first manipulation menu 400 may be shown. The user may then select one alternative from the plurality of alternatives 420 corresponding to a pronunciation the user prefers. The user may then use the pronunciation interface to transmit back to computing device 105 the user's preference. Computing device 105 may play back to the user an audible version on word 405's selected pronunciation.

Moreover, the user can indicate a stress for word 405. For example, the user can drag a stress symbol 430 from part-to-part in word 405 in the pronunciation interface. As shown in FIG. 4A and FIG. 4B, for example, the user can move stress symbol 430 from a first part to the second part to end up on a third part of plurality of parts 410. In this way, the user may indicate that the part "ah" in word 405 should be stressed.

FIG. 5 shows input menu 500. As shown in FIG. 5, input menu 500 may be used to collect pronunciation data from the user using user processor 110 and send it to computing device 105 over network 115. For example, the user may type a text string into a word box 505. Then the user may press a first record button 510 to record the user (or others) pronouncing the text string that was typed into word box 505. User processor 110 may combine the recording with the typed text representation to determine how the typed text should be pronounced and stressed. In other words, processor 110 may combine the recording with the typed text representation to give the text string the user's desired sound and stress.

Moreover, the user may press a second record button 515 to record the user (or others) pronouncing the text string that was typed into word box 505 a second time. Then the two recordings may be averaged to improve the overall recording quality. Furthermore, the process illustrated in FIG. 5 may be used in conjunction with the aforementioned processes of FIG. 3, FIG. 4A, and FIG. 4B to help the user tweak the pronunciation of the text string typed into word box 505.

Once computing device 105 receives the pronunciation data in stage 220, method 200 may continue to stage 230 where computing device 105 may generate a pronunciation based upon the received pronunciation data. Though not so limited, computing device 105 may generate the pronunciation in conjunction with an IVR environment. For example, with the pronunciation data received, computing device 105 may create a pronunciation of a text string that is more in line with a pronunciation the user desires. Furthermore, now that computing device 105 knows the user's preferred pronunciation, computing device 105 may add differences in prosody in other contexts. In other words, the text's pronunciation may not be limited to one context. For example, computing device 105 may give the text an "up" prosody or a "down" prosody depending upon the context in which the text is to be used. For example, these two types of prosody may be shown in the following: "Amherst is a destination for leaf peepers. If leaf peeping is your thing, go to Amherst." In this way, the text may not be limited to a single context. Once computing device 105 generates the pronunciation in stage 230, method 200 may then end at stage 240.

Regardless of how the pronunciation is set, once it is set, computing device 105 may use the pronunciation data received through the pronunciation interface to generalize corresponding audio across contexts (including use in different prompts and applications.) In addition, computing device 105 may "learn" from the received data to improve performance of un-trained terms. For example, if a particular text, word, syllable, phoneme, or character is given a certain pronunciation by a number of users in a particular community, computing device 105 may give this particular text, word, syllable, phoneme, or character this certain pronunciation as a default in the particular community. Communities may comprise, but are not limited to, regions of a country, industries, and populations.

An embodiment consistent with the invention may comprise a system for providing pronunciation generation. The system may comprise a memory storage and a processing unit coupled to the memory storage. The processing unit may be operative to provide a pronunciation interface configured to display a word and a plurality of alternatives corresponding to the word. In addition, the processing unit may be operative to receive pronunciation data through the pronunciation interface. The pronunciation data may indicate a one of the plurality of alternatives. Moreover, the processing unit may be operative to generate a pronunciation of the word based upon the received pronunciation data. The pronunciation may correspond to the indicated one of the plurality of alternatives.

Another embodiment consistent with the invention may comprise a system for providing pronunciation generation. The system may comprise a memory storage and a processing unit coupled to the memory storage. The processing unit may be operative to provide a pronunciation interface configured to display a word and a plurality of alternatives corresponding to a one of a plurality of parts of the word. Furthermore, the processing unit may be operative to receive pronunciation data through the pronunciation interface. The pronunciation data may indicate a one of the plurality of alternatives. Moreover, the processing unit may be operative to generate a pronunciation of the word based upon the received pronunciation data. The pronunciation may correspond to the indicated one of the plurality of alternatives.

Yet another embodiment consistent with the invention may comprise a system for providing pronunciation generation. The system may comprise a memory storage and a processing unit coupled to the memory storage. The processing unit may be operative to provide a pronunciation interface configured to prompt a user for text data and sound data corresponding to the text data. Moreover, the processing unit may be operative to receive the text data and the sound data through the pronunciation interface. Furthermore, the processing unit may be operative to correlate the text data with the sound data to produce pronunciation data. The pronunciation data may indicate how parts of the text data are to be pronounced as indicated by corresponding parts of the sound data. Also, the processing unit may be operative to generate a pronunciation of at least a portion of the text data based upon the pronunciation data.

Figure 6:
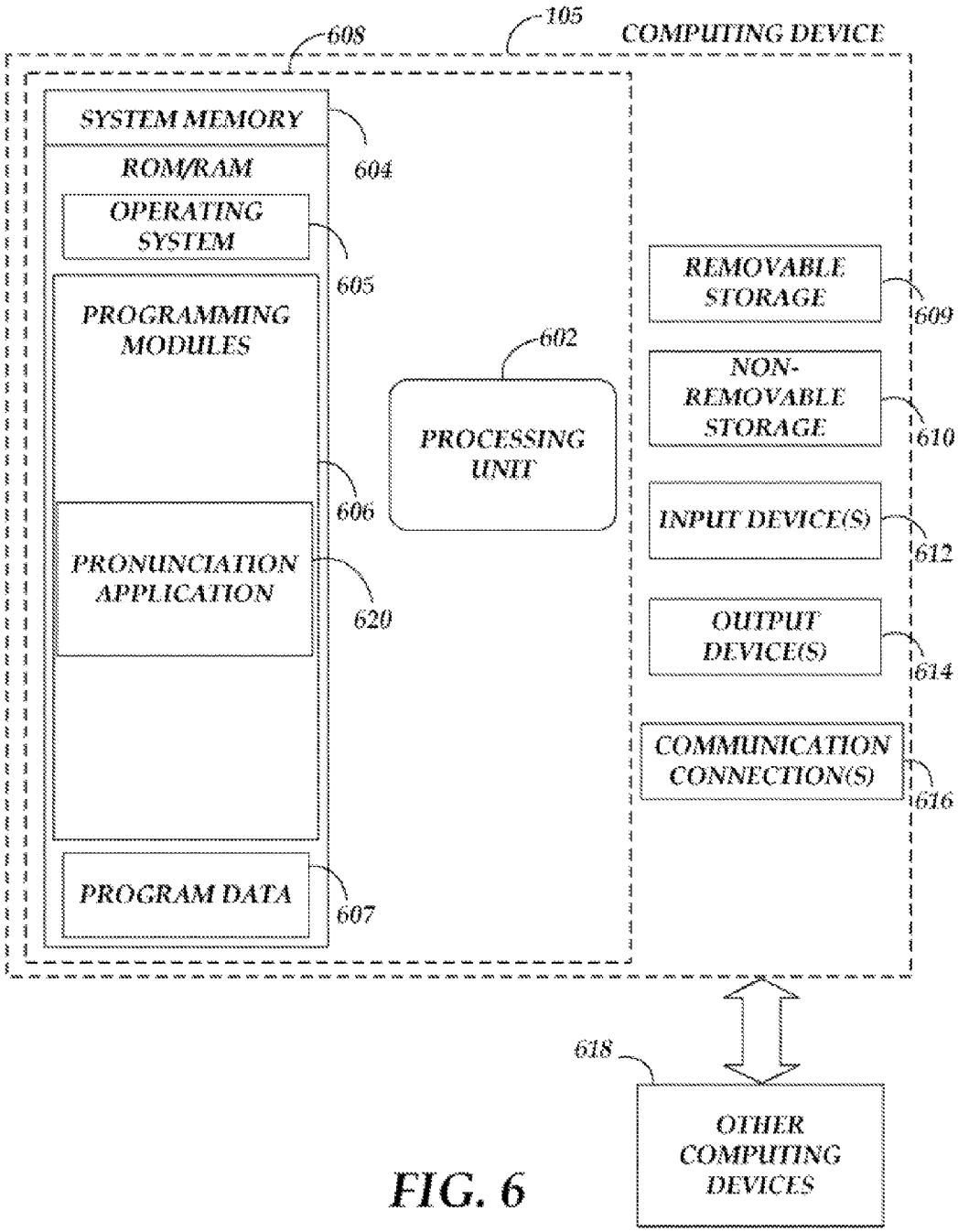
FIG. 6 is a block diagram of a system including a computing device.

FIG. 6 is a block diagram of a system including computing device 105. Consistent with an embodiment of the invention, the aforementioned memory storage and processing unit may be implemented in a computing device, such as computing device 105 of FIG. 6. Any suitable combination of hardware, software, or firmware may be used to implement the memory storage and processing unit. For example, the memory storage and processing unit may be implemented with computing device 105 or any of other computing devices 618, in combination with computing device 105. User processor 110 may comprise one of other computing devices 618. The aforementioned system, device, and processors are examples and other systems, devices, and processors may comprise the aforementioned memory storage and processing unit, consistent with embodiments of the invention.

With reference to FIG. 6, a system consistent with an embodiment of the invention may include a computing device, such as computing device 105. In a basic configuration, computing device 105 may include at least one processing unit 602 and a system memory 604. Depending on the configuration and type of computing device, system memory 604 may comprise, but is not limited to, volatile (e.g. random access memory (RAM)), non-volatile (e.g. read-only memory (ROM)), flash memory, or any combination. System memory 604 may include operating system 605, one or more programming modules 606, and may include a program data 607. Operating system 605, for example, may be suitable for controlling computing device 105's operation. In one embodiment, programming modules 606 may include, for example, a pronunciation application 620. Furthermore, embodiments of the invention may be practiced in conjunction with a graphics library, other operating systems, or any other application program and is not limited to any particular application or system. This basic configuration is illustrated in FIG. 6 by those components within a dashed line 608.

Computing device 105 may have additional features or functionality. For example, computing device 105 may also include additional data storage devices (removable and/or non-removable) such as, for example, magnetic disks, optical disks, or tape. Such additional storage is illustrated in FIG. 6 by a removable storage 609 and a non-removable storage 610. Computer storage media may include volatile and nonvolatile, removable and non-removable media implemented in any method or technology for storage of information, such as computer readable instructions, data structures, program modules, or other data. System memory 604, removable storage 609, and non-removable storage 610 are all computer storage media examples (i.e. memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 105. Any such computer storage media may be part of device 105. Computing device 105 may also have input device(s) 612 such as a keyboard, a mouse, a pen, a sound input device, a touch input device, etc. Output device(s) 614 such as a display, speakers, a printer, etc. may also be included. The aforementioned devices are examples and others may be used.

Computing device 105 may also contain a communication connection 616 that may allow device 105 to communicate with other computing devices 618, such as over network 115 in a distributed computing environment, for example, an intranet or the Internet. Communication connection 616 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both storage media and communication media.

As stated above, a number of program modules and data files may be stored in system memory 604, including operating system 605. While executing on processing unit 602, programming modules 606 (e.g. pronunciation application 620) may perform processes including, for example, one or more method 200's stages as described above. The aforementioned process is an example, and processing unit 602 may perform other processes. Other programming modules that may be used in accordance with embodiments of the present invention may include electronic mail and contacts applications, word processing applications, spreadsheet applications, database applications, slide presentation applications, drawing or computer-aided application programs, etc.

Generally, consistent with embodiments of the invention, program modules may include routines, programs, components, data structures, and other types of structures that may perform particular tasks or that may implement particular abstract data types. Moreover, embodiments of the invention may be practiced with other computer system configurations, including hand-held devices, multiprocessor systems, microprocessor-based or programmable consumer electronics, minicomputers, mainframe computers, and the like. Embodiments of the invention may also be practiced in distributed computing environments where tasks are performed by remote processing devices that are linked through a communications network. In a distributed computing environment, program modules may be located in both local and remote memory storage devices.

Furthermore, embodiments of the invention may be practiced in an electrical circuit comprising discrete electronic elements, packaged or integrated electronic chips containing logic gates, a circuit utilizing a microprocessor, or on a single chip containing electronic elements or microprocessors. Embodiments of the invention may also be practiced using other technologies capable of performing logical operations such as, for example, AND, OR, and NOT, including but not limited to mechanical, optical, fluidic, and quantum technologies. In addition, embodiments of the invention may be practiced within a general purpose computer or in any other circuits or systems.

Embodiments of the invention, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present invention may be embodied in hardware and/or in software (including firmware, resident software, micro-code, etc.). In other words, embodiments of the present invention may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present invention, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the invention have been described, other embodiments may exist. Furthermore, although embodiments of the present invention have been described as being associated with data stored in memory and other storage mediums, data can also be stored on or read from other types of computer-readable media, such as secondary storage devices, like hard disks, floppy disks, or a CD-ROM, a carrier wave from the Internet, or other forms of RAM or ROM. Further, the disclosed methods' stages may be modified in any manner, including by reordering stages and/or inserting or deleting stages, without departing from the invention.

All rights including copyrights in the code included herein are vested in and the property of the Applicant. The Applicant retains and reserves all rights in the code included herein, and grants permission to reproduce the material only in connection with reproduction of the granted patent and for no other purpose.

While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as examples for embodiments of the invention.

What is claimed is:

1. A method for providing pronunciation generation, the method comprising:

providing a pronunciation interface configured to display, a word, and a plurality of alternatives corresponding to the word;

receiving pronunciation data through the pronunciation interface, the pronunciation interface being configured to enable a user to manipulate a pronunciation of the word with a manipulation tool; and generating, by a computing device, a pronunciation of the word based upon the received pronunciation data.

2. The method of claim 1, wherein providing the pronunciation interface configured to display the word comprises providing the pronunciation interface configured to display the word being within a displayed text string.

3. The method of claim 1, wherein providing the pronunciation interface configured to display the plurality of alternatives comprises providing the pronunciation interface configured to display the plurality of alternatives, each of the plurality of alternatives indicating a pronunciation of the word comprising a heterograph.

4. The method of claim 1, wherein providing the pronunciation interface configured to display the plurality of alternatives comprises providing the pronunciation interface configured to display the plurality of alternatives, each of the plurality of alternatives indicating different pronunciations of the word.

5. The method of claim 1, wherein generating the pronunciation comprises generating the pronunciation by one of the following: an interactive voice response (IVR) system and an automated teller machine (ATM).

6. A computer-readable non-transitory storage medium that stores a set of instructions which when executed perform a method for providing pronunciation generation, the method executed by the set of instructions comprising:

providing a pronunciation interface configured to display, a word, and a plurality of alternatives corresponding to a one of a plurality of parts of the word;

receiving pronunciation data through the pronunciation interface, the pronunciation data indicating a one of the plurality of alternatives, the pronunciation interface being configured to manipulate a pronunciation of the word via a manipulation tool; and generating a pronunciation of the word based upon the received pronunciation data, the pronunciation corresponding to the indicated one of the plurality of alternatives.

7. The computer-readable non-transitory storage medium of claim 6, wherein providing the pronunciation interface configured to display the word comprises providing the pronunciation interface configured to display the word being within a displayed text string.

8. The computer-readable non-transitory storage medium of claim 6, wherein providing the pronunciation interface configured to display the plurality of alternatives corresponding to the one of the plurality of parts of the word comprises providing the pronunciation interface configured to display the plurality of alternatives corresponding to the one of the plurality of parts wherein the plurality of parts comprise syllables of the word.

9. The computer-readable non-transitory storage medium of claim 6, wherein providing the pronunciation interface configured to display the plurality of alternatives corresponding to the one of the plurality of parts of the word comprises providing the pronunciation interface configured to display the plurality of alternatives corresponding to the one of the plurality of parts wherein the plurality of parts comprise phonemes comprising the word.

10. The computer-readable non-transitory storage medium of claim 6, wherein providing the pronunciation interface comprises providing the pronunciation interface configured to display a user selectable element configured to indicate which one of the plurality of parts of the word is stressed.

11. The computer-readable non-transitory storage medium of claim 6, wherein receiving the pronunciation data through the pronunciation interface comprises receiving the pronunciation data indicating which one of the plurality of parts of the word is stressed.

12. The computer-readable non-transitory storage medium of claim 6, wherein receiving the pronunciation data through the pronunciation interface comprises receiving the pronunciation data indicating which one of the plurality of parts of the word is stressed in response to a user sliding a user selectable element to indicate which one of the plurality of parts of the word is stressed.

13. The computer-readable non-transitory storage medium of claim 6, wherein providing the pronunciation interface comprises displaying, on a first manipulation menu, the word and the plurality of parts of the word.

14. The computer-readable non-transitory storage medium of claim 13, wherein providing the pronunciation interface comprises displaying, on a second manipulation menu, the word and the plurality of alternatives corresponding to the one of the plurality of parts of the word in response to a user selecting the one of a plurality of parts of the word from the first manipulation menu.

15. The computer-readable non-transitory storage medium of claim 6, wherein generating the pronunciation of the word comprises generating the pronunciation of the word with an up prosody based upon a context of the generated pronunciation.

16. The computer-readable non-transitory storage medium of claim 6, wherein generating the pronunciation of the word comprises generating the pronunciation of the word with a down prosody based upon a context of the generated pronunciation.

17. The computer-readable non-transitory storage medium of claim 6, wherein generating the pronunciation comprises generating the pronunciation by one of the following: an interactive voice response (IVR) system and an automated teller machine (ATM).

18. A system for providing pronunciation generation, the system comprising:

a memory storage; and a hardware processing unit coupled to the memory storage, wherein the hardware processing unit is operative to:

provide a pronunciation interface configured to prompt a user for text data and sound data corresponding to the text data, the pronunciation interface comprising a manipulation tool for altering a pronunciation of at least a portion of the text data;

receive the text data and the sound data through the pronunciation interface;

correlate the text data with the sound data to produce pronunciation data, the pronunciation data indicating how parts of the text data are to be pronounced as indicated by corresponding parts of the sound data; and generate a pronunciation of the at least a portion of the text data based upon the pronunciation data.

19. The system of claim 18, wherein the hardware processing unit being operative to receive the text data and the sound data through the pronunciation interface comprises the hardware processing unit being operative to:

receive the text data through a word box on an input menu corresponding to the pronunciation interface; and receive the sound data in response to a user initiating a record button on the input menu.

20. The system of claim 18, wherein the hardware processing unit being operative to generate the pronunciation of the word comprises the hardware processing unit being operative to generate the pronunciation of the word with one of the following: an up prosody based upon a context of the generated pronunciation and a down porosity based upon the context of the generated pronunciation.

* * * * *

UNITED STATES PATENT AND TRADEMARK OFFICE

CERTIFICATE OF CORRECTION

PATENT NO. : 8,160,881 B2
APPLICATION NO. : 12/334590
DATED : April 17, 2012
INVENTOR(S) : Klee et al.

It is certified that error appears in the above-identified patent and that said Letters Patent is hereby corrected as shown below:

In the Claims

In column 10, line 61, In Claim 20, delete "prosity" and insert -- prosody --, therefor.

Signed and Sealed this
Third Day of February, 2015

Michelle K. Lee

Michelle K. Lee
*Deputy Director of the United States Patent and Trademark Office*